US009815110B2

(12) United States Patent
Cheong et al.

(10) Patent No.: US 9,815,110 B2
(45) Date of Patent: Nov. 14, 2017

(54) EDGE DAM OF TWIN ROLL TYPE STRIP CASTER

(71) Applicant: POSCO, Pohang-si (KR)

(72) Inventors: Han Nam Cheong, Pohang-si (KR); Oh Seong Kweon, Pohang-si (KR)

(73) Assignee: POSCO, Pohang-si (KR)

( * ) Notice: Subject to any disclaimer, the term of this patent is extended or adjusted under 35 U.S.C. 154(b) by 0 days.

(21) Appl. No.: 15/384,846

(22) Filed: Dec. 20, 2016

(65) Prior Publication Data

US 2017/0173676 A1 Jun. 22, 2017

(30) Foreign Application Priority Data

Dec. 21, 2015 (KR) ..... 10-2015-0183114

(51) Int. Cl.
*B22D 11/06* (2006.01)

(52) U.S. Cl.
CPC ..... *B22D 11/066* (2013.01); *B22D 11/0622* (2013.01)

(58) Field of Classification Search
CPC ... B22D 11/06; B22D 11/066; B22D 11/0648; B22D 11/0622
See application file for complete search history.

(56) References Cited

U.S. PATENT DOCUMENTS

2012/0273156 A1 11/2012 Nakayama et al.

FOREIGN PATENT DOCUMENTS

| | | |
|---|---|---|
| JP | 0443447 | 4/1992 |
| JP | 2001087842 | 4/2001 |
| JP | 2004122193 | 4/2004 |
| JP | 2012228721 | 11/2012 |
| KR | 20050064418 | 6/2005 |
| KR | 1020150020944 | 2/2015 |

OTHER PUBLICATIONS

Korean Office Action—Korean Application No. 10-2015-0183114 dated Jan. 31, 2017, citing JP 2004-122193 and KR 10-2015-0020944.

*Primary Examiner* — Kevin P Kerns
*Assistant Examiner* — Steven Ha
(74) *Attorney, Agent, or Firm* — Cantor Colburn LLP

(57) ABSTRACT

An edge dam of a twin roll type strip caster is provided as a refractory material having a sealing member for sealing both end surfaces of a pair of casting rolls, and is pressed and raised according to wear of the sealing member. To uniformly maintain a contact area of the sealing member and the casting roll in a process in which the edge dam is moved while the edge dam is pressed and raised, both sides and a lower part of the sealing member are formed as an inclined surface inclined inwardly of the sealing member. An angle of inclination of the inclined surface is increased in a direction in which the sealing member is raised, and the angle of inclination θ of the inclined surface is obtained by a relationship between a moving distance l due to raising of the edge dam and a wear depth d.

3 Claims, 4 Drawing Sheets

EDGE DAM OF TWIN ROLL TYPE STRIP CASTER

CROSS-REFERENCE TO RELATED APPLICATION

This application claims the benefit of priority to Korean Patent Application No. 10-2015-0183114, filed on Dec. 21, 2015 with the Korean Intellectual Property Office, the entirety of which is incorporated herein by reference.

BACKGROUND

The present disclosure relates to an edge dam of a twin roll type strip caster in close contact with both side surfaces of a casting roll used in a twin roll type strip caster to prevent leakage of molten steel.

A twin roll type caster according to the related art is an apparatus for rotating a pair of casting rolls in a direction in which the pair of casting rolls face each other, and pouring molten steel into a space between the pair of casting rolls to continuously cast strips.

With reference to FIG. 1, in a twin roll type strip caster, molten steel is supplied to the space between a pair of casting rolls R and R' facing each other and disposed to be parallel to each other, and a pair of edge dams E and E' formed of a flat refractory material in a trapezoidal form on both ends of the casting rolls R and R' are installed to confine molten steel between casting rolls R and R' and to form a slab to have a uniform width.

A level of performance of the edge dams E and E' is an important factor in determining casting stability, maximum casting capacity, as well as edge quality of a strip, and the edge dams E and E' are provided to have various sizes, shapes, material compositions, and the like, of a refractory material according to a diameter of a casting roll, casting capacity, an operating method, a grade of steel, and the like.

In addition, to allow the edge dams E and E' to stably seal molten steel during casting, the edge dams E and E' are required to be pressed by end surfaces of the casting rolls R and R'. To this end, to press the edge dams E and E' to end surfaces of the casting rolls R and R' with a predetermined degree of force to be in close contact therewith during casting, devices for fixing and driving an edge dam are provided on a side surface or a rear surface of the edge dams E and E'.

A fixing device is a device for mounting the edge dams E and E' to be firmly fixed. In addition, on a rear surface of the fixing device, driving devices for adjusting positions of the edge dams E and E' towards the front and the rear, the top and the bottom, and the left and the right are provided.

However, as the edge dams E and E' are pressed by end surfaces of the casting rolls R and R', a sealing member 1 (see FIG. 2) is continuously worn. When the sealing member 1 is worn by more than a certain amount, molten steel may be leaked. Thus, there may be limitations on performing further casting.

In detail, as the sealing member 1 provided for the edge dams E and E' is continuously worn, the casting rolls R and R' may dig into a surface of the sealing member further and further to be embedded therein. In addition, a width of a molten steel solidified shell formed on the surface of the casting rolls R and R' and a width of a slab are reduced by an amount equal to a depth to which the casting rolls R and R' are embedded.

In addition, due to continuous friction between a solidified shell formed on a surface of the casting rolls R and R' and a specific portion of the sealing member 1, a groove is generated in the sealing member 1. When the groove is worn beyond a certain depth, problems in which a quality of an edge portion of a slab is poor, molten steel leaks, and the like, may occur.

As disclosed in Japanese Utility Model Publication No. 1992-043447 and Korean Patent Application No. 2003-0095779, according to the related art, a device for raising the edge dam E is provided, and a method for raising the edge dams E and E' in proportion to an amount by which the sealing member 1 is worn is suggested.

However, in a structure such as that described above, in comparison to an area in which a sealing member of an edge dam is initially in contact with a casting roll, when the edge dam is raised, an area contacting a casting roll is reduced. Thus, a degree of wear of the sealing member 1 is increased, a problem in which a service life is sharply reduced may occur.

FIG. 2 is a front view of an edge dam of a twin roll type strip caster according to the related art, while FIG. 3 is a cross-sectional view taken along line I-I' of FIG. 2. In addition, FIG. 4 is a front view of an initial position and a raised position of an edge dam of a twin roll type strip caster according to the related art, and FIG. 5 is a cross-sectional view taken along line II-II' of FIG. 4.

With reference to FIGS. 2 to 5, an edge dam E includes a sealing member 1, and the sealing member 1 is in close contact with an end surface of a casting roll R to seal a gap.

The edge dam E is worn while casting is performed, and the edge dam E is continuously pressed and raised.

However, while casting is performed in the edge dam E, a surface in which the sealing member 1 is in contact with the casting roll R is worn, and thus, in comparison to an area in which the sealing member is in contact with the casting roll at a beginning of casting, a contact area is gradually reduced. (In FIG. 4, a deviant crease lined part P illustrates a part in which the sealing member 1 is in contact with the casting roll R).

Meanwhile, both side surfaces of the sealing member 1 of the edge dam E are formed at an incline. A structure described above is a structure for preventing edges of the sealing member 1 from being easily damaged in a case in which the edges thereof form a right angle.

Due to the structure described above, a difference in contact areas of the sealing member 1, in a process in which the edge dam E according to the related art is raised, may be somewhat reduced. However, with such a structure alone, there are limitations on preventing the contact areas of the sealing member 1 from being different, and thus, there are limitations on relieving concentrations of stress and increases in wear.

SUMMARY

An aspect of the present disclosure provides an edge dam of a twin roll type strip caster allowing a contact surface to be constantly uniformly worn in a process in which a sealing member of an edge dam is in contact with a casting roll to be used, to prevent variations in wear due to concentrations of stress, thereby maintaining molten steel in a stably sealed state.

According to an aspect of the present disclosure, an edge dam of a twin roll type strip caster is provided as a refractory material having a sealing member for sealing both end surfaces of a pair of casting rolls, and is pressed and raised according to wear of the sealing member. To uniformly maintain a contact area of the sealing member and the casting roll in a process in which the edge dam is moved while the edge dam is pressed and raised, both sides and a lower part of the sealing member are formed as an inclined surface inclined inwardly of the sealing member. An angle of inclination of the inclined surface is increased in a direction in which the sealing member is raised, and the angle of inclination θ of the inclined surface is obtained by an Equation according to a relationship between a moving distance l due to raising of the edge dam and a wear depth d.

$$\tan\theta = \frac{\text{Moving distance } l \text{ due to raising of edge dam}}{\text{Wear depth } d} \quad \text{Equation}$$

Outlines of both sides of the sealing member in contact with the casting roll at a beginning of casting may be concentric with each casting roll, and the sealing member may be formed to have a radius equal to a value in which a distance of a contact area of the sealing member and the casting roll is subtracted from a radius of the casting roll.

The edge dam may be pressed and raised to allow the angle of inclination θ of the inclined surface to be at least 5 degrees or more.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
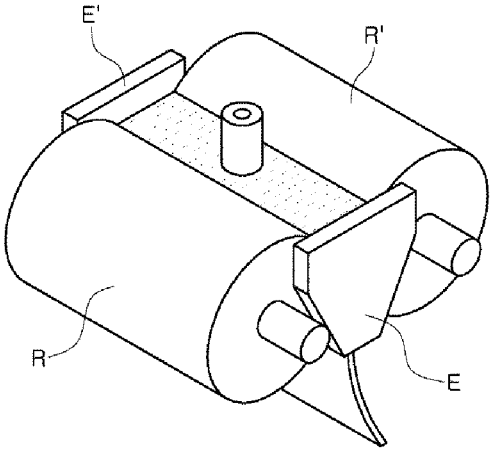
PRIOR ART FIG. 1
FIG. 1 is a perspective view illustrating that an edge dam is installed in a general twin roll type strip caster.
Figure 2:
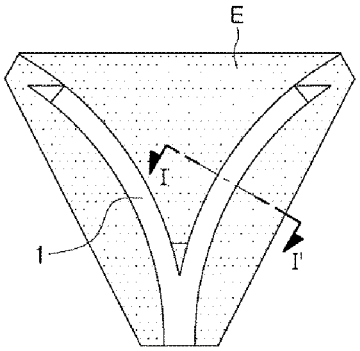
PRIOR ART FIG. 2
FIG. 2 is a front view of an edge dam of a twin roll type strip caster according to the related art.
Figure 3:
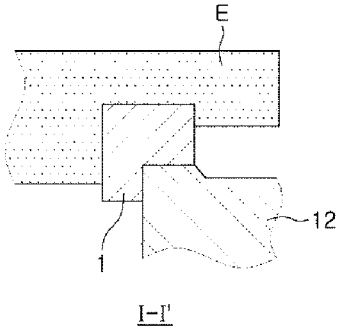
PRIOR ART FIG. 3
FIG. 3 is a cross-sectional view taken along line I-I' of FIG. 2.
Figure 4:
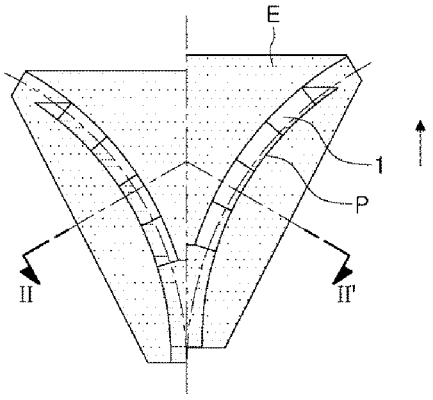
PRIOR ART FIG. 4
FIG. 4 is a front view of an initial position and a raised position of an edge dam of a twin roll type strip caster according to the related art.
Figure 5:
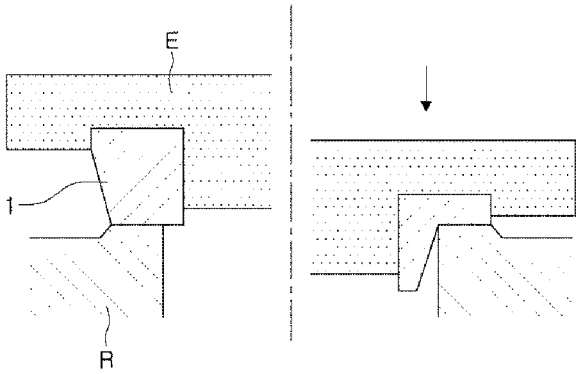
PRIOR ART FIG. 5
FIG. 5 is a cross-sectional view taken along line II-II' of FIG. 4.

Hereinafter, embodiments of the present disclosure will be described as follows with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no other elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship relative to another element(s) as shown in the figures. It will be understood that the spatially relative terms are intended to encompass different orientations of the device in use or operation in addition to the orientation depicted in the figures. For example, if the device in the figures is turned over, elements described as "above," or "upper" relative to other elements would then be oriented "below," or "lower" relative to the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views illustrating embodiments of the present disclosure. In the drawings, for example, due to manufacturing techniques and/or tolerances, modifications of the shape shown may be estimated. Thus, embodiments of the present disclosure should not be construed as being limited to the particular shapes of regions shown herein, for example, to include a change in shape results in manufacturing. The following embodiments may also be constituted by one or a combination thereof.

The contents of the present disclosure described below may have a variety of configurations and propose only a required configuration herein, but are not limited thereto.

Figure 6:
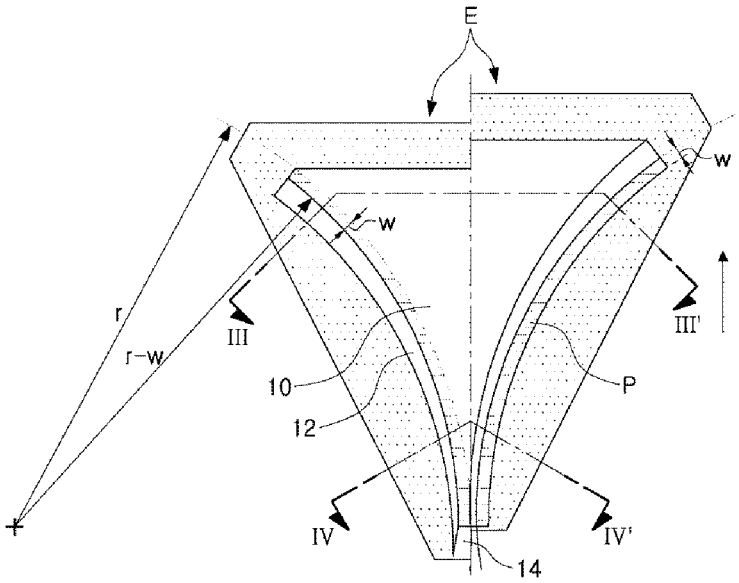
FIG. 6 is a front view of an initial position and a raised position of an edge dam of a twin roll type strip caster according to an exemplary embodiment of the present disclosure.
Figure 7:
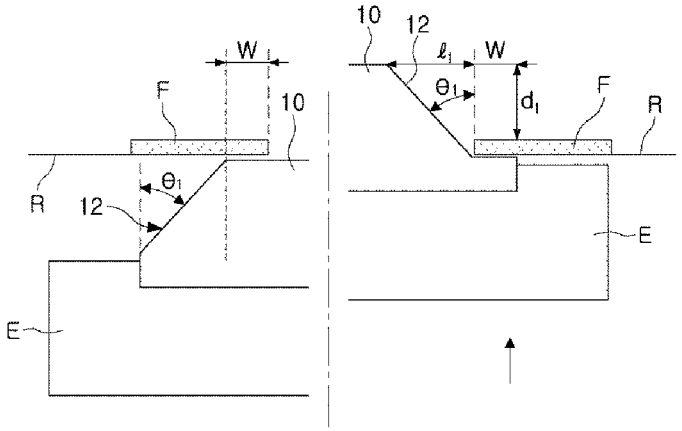
FIG. 7 is a cross-sectional view taken along line III-III' of FIG. 6.
Figure 8:
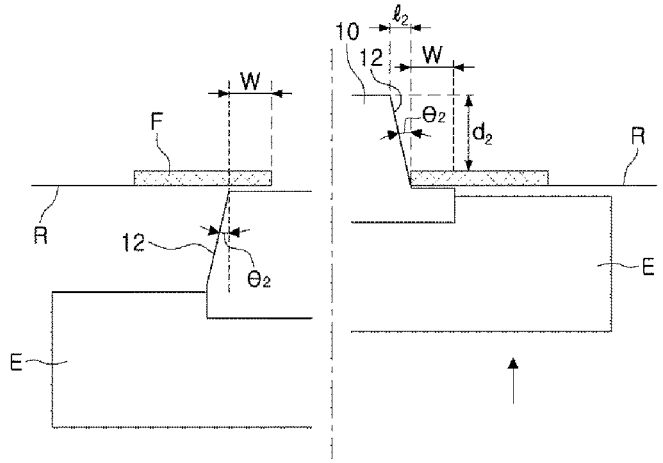
FIG. 8 is a cross-sectional view taken along line IV-IV' of FIG. 6.

FIG. 6 is a front view illustrating an initial position and a raised position of an edge dam of a twin roll type strip caster according to an exemplary embodiment, FIG. 7 is a cross-sectional view taken along line III-III' of FIG. 6, and FIG. 8 is a cross-sectional view taken along line IV-IV' of FIG. 6.

With reference to FIGS. 6 to 8, edge dams E of a twin roll type strip caster according to an exemplary embodiment are provided as a single pair, and the pair of edge dams E may be used for sealing a gap between a pair of casting rolls R installed to face each other in parallel, to forma space filled with molten steel.

The edge dam E may be provided as a refractory material, and a sealing member 10 may be disposed in a position in which the edge dam is in contact with the casting roll R.

The sealing member 10 is in contact with the casting roll R to seal a gap, and may prevent wear or damage caused as a refractory material is directly in contact with the casting roll R.

In addition, a contact pad F may be provided for the casting roll R in a position in which the casting roll is in contact with the sealing member 10.

In addition, during a casting process, as the sealing member 10 is pressed by the casting roll R, the edge dam E may be worn. Moreover, the edge dam E may be pressed and raised to prevent a gap from being generated as wear occurs during a casting process. (In FIG. 6, a deviant crease lined part P illustrates a position in which the sealing member 10 is in contact with the casting roll R.)

Meanwhile, the edge dam E is preferably provided to uniformly maintain a contact area of the sealing member 10 and the casting roll R in a process in which the edge dam is moved while the edge dam is pressed and raised. Here, w denotes a cross sectional distance w of a contact area. To this end, in an exemplary embodiment, both sides and a lower part of the sealing member 10 may be formed as inclined surfaces 12 and 14 inclined inwardly of the sealing member 10.

In an exemplary embodiment, a drawing is illustrated by way of example of the inclined surface 12 provided for a side surface of the sealing member 10.

In detail, in the inclined surface 12 of the sealing member 10, an angle of inclination thereof may be increased in a direction in which the edge dam E is raised.

In this case, a moving distance on a side of an upper part of the sealing member 10 due to raising of the edge dam E is increased, in comparison to a moving distance on a side of a lower part of the sealing member. Thus, even when the edge dam E is raised and moving distances between the upper part and the lower part of the sealing member 10 are different, a contact area may be uniformly maintained.

In detail, in an exemplary embodiment, an angle of inclination θ of the inclined surface 12 of the sealing member 10 is obtained by Equation 1 according to a relationship between a moving distance l due to raising of the edge dam E and a wear depth d.

$$\tan\theta = \frac{\text{Moving distance l due to raising of edge dam}}{\text{Wear depth } d} \quad \text{[Equation 1]}$$

In other words, force, by which the edge dam E is pressed, allows the edge dam to be pressed to maintain wear of the sealing member 10 at a uniform ratio by an edge dam pressurization device (not shown). In this case, when a contact area of the sealing member 10 and the casting roll R is taken as being uniform, force by which the sealing member 10 is pressed is taken as being uniform. Thus, a degree to which the sealing member 10 is worn, that is, a depth d, may be determined.

In addition, when the edge dam E is raised, a difference in a moving distance may occur according to a position in which the sealing member 10 is in contact with the casting roll R.

With reference to FIG. 7, in an upper part of the sealing member 10, a distance in which the sealing member 10 is in contact with the casting roll R when casting is initial, is w. In addition, a side surface of the sealing member 10 may be provided as the inclined surface 12 inclined at a predetermined angle $\theta_1$.

The edge dam E may be worn as casting is performed, and may be raised at the same time.

In this case, as a side surface of the sealing member 10 is provided at an incline, even when the edge dam E is raised, a contact area is constantly uniformly maintained. Thus, while a distance w of a part in which the casting roll R is in contact with the sealing member 10 is maintained as a distance which is constantly uniform, the edge dam E may be pressed and raised.

Meanwhile, when a moving distance $l_1$ due to raising the edge dam E in an upper part of the edge dam E is divided by a wear depth $d_1$, tan $\theta_1$ is obtained. Thus, $\theta_1$ may be calculated thereby.

With reference to FIG. 8, in a lower part of the sealing member 10, a distance in which the sealing member 10 is in contact with the casting roll R when casting is initial, is w. Areas of parts in which an upper part and a lower part of the sealing member 10 are in contact with the casting roll R are the same, in other words, distances w are the same.

In addition, a side surface of the sealing member 10 may be provided as the inclined surface 12 inclined at a predetermined angle $\theta_2$.

The edge dam E is worn as casting is performed, and may be raised at the same time.

In this case, as a side surface of the sealing member 10 is provided at an incline, even when the edge dam E is raised, a contact area is constantly uniformly maintained. Thus, while a distance w of a part in which the casting roll R is in contact with the sealing member 10 is maintained as a distance which is constantly uniform, the edge dam E may be pressed and raised.

Meanwhile, a moving distance $l_2$ due to raising of the edge dam E may be short in a lower part of the sealing member 10, in comparison with an upper part thereof. When the moving distance $l_2$ due to raising of the edge dam E in the lower part of the edge dam E is divided by a wear depth $d_2$, tan $\theta_2$ may be obtained. Thus, $\theta_2$ may be calculated thereby.

In this case, in a lower part of the sealing member 10, a moving distance l due to raising of the edge dam E is short in comparison to an upper part thereof. Thus, an angle of the inclined surface 12 is also small (that is, $\theta_1 > \theta_2$). The inclined surface 12 of the sealing member 10 may be formed to have an overall form in which an angle is gradually increased from a lower part to an upper part.

In the sealing member 10, outlines of both side surfaces in contact with the casting roll R at a beginning of casting may correspond to a form of the casting roll R. For example, outlines of both sides of the sealing member 10 in contact with the casting roll R at a beginning of casting may be concentric with each casting roll R. In addition, a radius of the sealing member 10 may be a value in which a distance of an area in contact with the casting roll R is subtracted from a radius of the casting roll R, as an area in which the sealing member 10 is in contact with the casting roll R is constantly uniform.

Meanwhile, in an exemplary embodiment, in a case in which an angle of the inclined surface 12 of the sealing member 10 is significantly small, load may be concentrated on an edge part. Thus, the inclined surface 12 is preferably formed to have an appropriate angle.

For example, in an exemplary embodiment, in a case in which the angle of inclination θ of the inclined surface 12 of the sealing member 10 is less than 5 degrees, stress may be concentrated on an edge part, and thus, the edge part may be easily broken. Thus, in the edge dam E, the angle of inclination θ of the inclined surface 12 of the sealing member 10 may be preferably formed to be at least 5 degrees or more.

Meanwhile, in the sealing member 10, outlines of both side surfaces are in contact with a casting roll R at an end of casting may be located in a position in which the outlines thereof are moved by an amount equal to a distance corresponding to an angle calculated by Equation 1.

As set forth above, according to an exemplary embodiment, an edge dam may be raised by an amount corresponding to wear of the edge dam during casting. In this process, as a width of a sealed surface in which a casting roll is in contact with a sealing member from an upper end of the edge dam to a lower end thereof may be uniformly maintained, load applied to the edge dam may uniformly distributed. Thus, while a wear rate is uniformly maintained, wear may be significantly reduced. A sealed state of molten steel may be stably maintained. Durability of the edge dam may be increased, thereby preventing damage. Molten steel is prevented from leaking during casting, thereby improving an overall casting quality and improving productivity.

While exemplary embodiments have been shown and described above, it will be apparent to those skilled in the art that modifications and variations could be made without departing from the scope of the present invention as defined by the appended claims.

What is claimed is:

1. An edge dam of a twin roll strip caster, wherein an edge dam is provided as a refractory material having a sealing member for sealing both end surfaces of a pair of casting rolls, and is pressed and raised according to wear of the sealing member, both sides and a lower part of the sealing member are formed as an inclined surface inclined inwardly of the sealing member, to uniformly maintain a contact area of the sealing member and the casting roll in a process in which the edge dam is moved while the edge dam is pressed and raised, an angle of inclination of the inclined surface is increased in a direction in which the sealing member is raised, and the angle of inclination θ of the inclined surface is obtained by an Equation according to a relationship between a moving distance l due to raising of the edge dam and a wear depth d, and the equation is as follows:

$$\tan\theta = \frac{\text{Moving distance l due to raising of edge dam}}{\text{Wear depth } d}.$$

2. The edge dam of a twin roll strip caster of claim 1, wherein outlines of both sides of the sealing member in contact with the casting roll at a beginning of casting are concentric with each casting roll, and the sealing member is formed to have a radius equal to a value in which a distance of a contact area of the sealing member and the casting roll is subtracted from a radius of the casting roll.

3. The edge dam of twin roll strip caster of claim 1, wherein the edge dam is pressed and raised to allow the angle of inclination θ of the inclined surface to be at least 5 degrees or more.

* * * * *